United States Patent [19]

Moran, Jr.

[11] Patent Number: 4,768,350

[45] Date of Patent: Sep. 6, 1988

[54] A/C - EVAPORATIVE COOLER SUN SHROUD

[76] Inventor: Henry Moran, Jr., 1270 N. Laspina, Tulare, Calif. 93274-2369

[21] Appl. No.: 62,079

[22] Filed: Jun. 15, 1987

[51] Int. Cl.[4] ..... F25D 23/12

[52] U.S. Cl. ..... 62/259.1; 62/DIG. 16; 312/100

[58] Field of Search ..... 62/259.1, 262, 304, 62/DIG. 16; 312/100

[56] References Cited

U.S. PATENT DOCUMENTS

| | | | |
|---|---|---|---|
| 2,874,551 | 6/1955 | Bradbury et al. . | |
| 3,006,498 | 1/1959 | Thiede et al. . | |
| 3,379,481 | 4/1968 | Fisher | 312/100 |
| 3,938,694 | 2/1976 | Archuleta | 220/77 |
| 4,118,083 | 10/1978 | Lackey et al. | 62/259.1 X |
| 4,288,051 | 9/1981 | Carlson et al. | 52/94 |
| 4,376,082 | 3/1983 | Heck | 62/259.4 X |
| 4,385,474 | 5/1983 | Earley | 52/3 X |
| 4,498,912 | 2/1985 | Wagner | 62/DIG. 16 |

*Primary Examiner*—Lloyd L. King

*Attorney, Agent, or Firm*—Fleit, Jacobson, Cohn & Price

[57] ABSTRACT

A sun shroud is provided for a cooler housing and incorporates downwardly and outwardly inclined panel portions supported from and extending along upper marginal edges of the peripheral walls of the housing and a horizontal panel of a plan size and shape corresponding to the plan size and shape of the housing is provided and supported in vertically spaced relation above the top wall of the housing, the inclined panel portions including upper marginal edges spaced above the upper marginal edges of the side walls of the housing and below the corresponding marginal edges of the horizontal panel.

12 Claims, 3 Drawing Sheets

FIG. 1
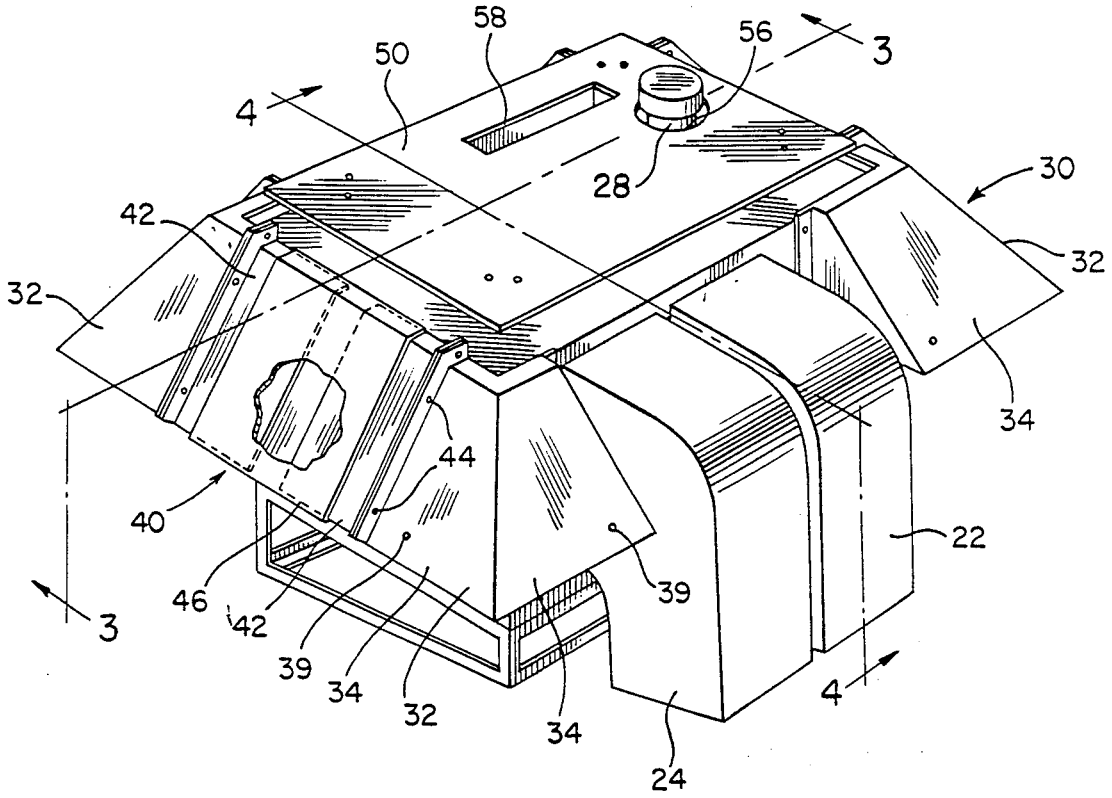
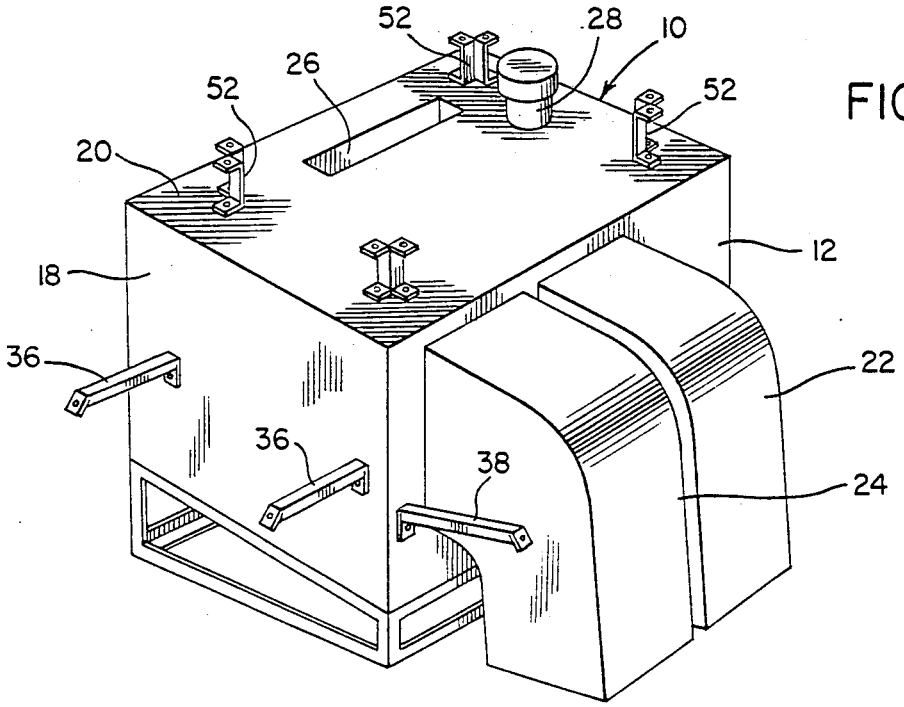
FIG. 2

A/C - EVAPORATIVE COOLER SUN SHROUD

BACKGROUND OF THE INVENTION

1. Field of the Invention

Air conditioner and evaporative cooler housings, especially those mounted on rooftops, are most often constructed of metal and are further often positioned such that they are exposed to direct sunlight incident thereon. Accordingly, these housings may become highly heated by solar energy with the result that the air conditioning or evaporative cooler structure housed therein is unnecessarily subject to ambient heat loads resulting in reduced efficiency of the air conditioning or evaporative cooler units. Accordingly, a need exists for a sun shroud structure whereby substantial portions of such housings may be shaded from direct sunlight falling incident thereon.

In addition, air conditioning components within an exteriorly mounted housings include condenser units which are primarily air cooled and have a tendency to heat the walls of the housing from the interior thereof. Accordingly, even though a sun shroud may be provided for preventing sunlight from falling directly upon the housing, a further need exists for facilitating air circulation about the exterior surfaces of the housings in order to cool a buildup of heat in the housing walls as a result of radiant heat energy from within the housings.

2. Description of Related Art

Various different forms of shroud structures including some of the general structural and operational features of the instant invention are disclosed in U.S. Pat. Nos. 2,874,551, 3,006,498, 3,938,694, 4,288,951, 4,376,082, 4,385,474 and 4,498,912. However, these previously known forms of shrouds do not include the overall combination of structural features of the instant invention which enable the shroud to be manufactured for use in conjunction with housings of different sizes by merely changing the dimensions of one of the components of the shroud.

SUMMARY OF THE INVENTION

The sun shroud of the instant invention is designed to be used on an air conditioner or evaporative cooler housing having relatively angulated peripheral sides and wherein adjacent peripheral sides intersect at corner portions of the housing. The shroud includes corner sections each including a pair of downwardly and outwardly inclined panel portions angulated relative to each other and extending in directions toward the adjacent corner portions of the housing. The corner section panel portions extending along each side of the housing between adjacent housing corner portions are spaced apart and a connecting panel assembly extends between each pair of spaced apart panel portions.

Each connecting panel assembly includes opposite end spaced apart end panel sections supported from the corresponding corner section panel portions and a bridging panel is slidably overlappingly engaged with, supported from and extending between the corresponding end panel sections. In this manner, the shroud assembly may be readily expanded or contracted for use in conjunction with different size housings.

In addition, a horizontal panel of a plan size and shape corresponding to the plan size and shape of a particular housing with which the horizontal panel is to be used is provided and supported from the top wall of the housing in vertically spaced relation relative thereto and in vertically spaced relation above the upper marginal edges of the corner section panel portions and the connecting panel assemblies whose upper marginal edges are also spaced vertically above the upper marginal edges of the corresponding peripheral sides of the associated housing.

The main object of this invention is to provide a sun shroud for A/C—evaporative cooler housings whereby the housings may be shielded against direct sunlight incident thereon.

Another object of this invention, in accordance with the immediately preceding object, is to provide a shroud which will also facilitate the circulation of ambient air about the external surfaces of the associated housing to thereby cool those surfaces to at least some degree from radiant heat energy absorbed thereby from within the housing.

Yet another object of this invention is to provide a shroud construction in accordance with the preceding objects and which may be manufactured, except for one component thereof, in a single size for use in conjunction with different size housings.

A further object of this invention is to provide a sun shroud which may be manufactured and shipped in a compact knock-down state and readily erected at the point of use.

A final object of this invention to be specifically enumerated herein is to provide a sun shroud in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like part throughout.

BRIEF DESCRIPTION OF THE DRAWINGS

FIG. 1 is a perspective view of a typical form of A/C or evaporator cooler housing with which the sun shroud of the instant invention is operatively associated, portions of one of the expandable and contractable sides of the housing being broken away;

FIG. 2 is a perspective view of the housing preparatory to mounting the sun shroud thereon;

DESCRIPTION OF THE PREFERRED EMBODIMENT

Figure 3:
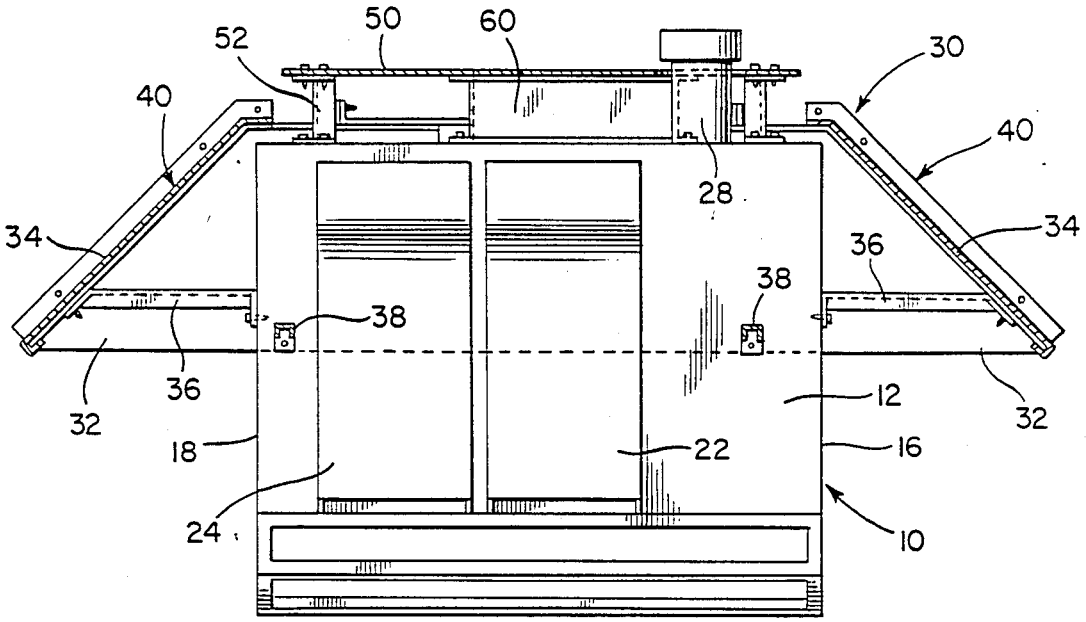
FIG. 3 is an enlarged vertical sectional view taken substantially upon the plane indicated by the section line 3-3 of FIG. 1.

Referring now more specifically to the drawings, the numeral 10 generally designates an air conditioner housing which is generally rectangular in plan shape and includes upstanding opposite side walls 12 and 14 interconnected by opposite end walls 16 and 18, a top wall 20 extending between the upper marginal edges of the walls 12, 14, 16 and 18. Further, the wall 12 has inlet and outlet ducts 22 and 24 opening therethrough into the interior of the housing 10, the ducts 22 and 24 comprising return and supply air ducts for the air conditioner housing 10. In addition, the top wall may include a condenser cooling air outlet opening 26 and an upwardly projecting capped flue pipe 28 (for gas operated air conditioning units).

The sun shroud assembly is referred to in general by the reference numeral 30 and includes four corner sections 32. each including a pair of interconnected, downwardly and outwardly inclined relatively angulated panel portions 34. The corner sections 32 are each supported from the corresponding corner of the rectangular housing 10 through the utilization of a pair of mounting brackets 36 and 38 suitably mounted from the housing 10 and secured to the corresponding corner section 32 through the utilization of suitable fasteners 39. The panel portions 34 extend along corresponding upstanding walls of the housing 10 toward the adjacent corners of the housing 10 and each pair of panel portions 34 extending along an upstanding wall of the housing 10 are spaced apart.

Three pairs of adjacent corner sections 32 are interconnected through the utilization of three connecting panel assemblies each referred to in general by the reference numeral 40 and each connecting panel assembly 40 includes a pair of opposite end panel sections 42 secured to the corresponding panel portion 34 as at 44. The end panel sections 42 of each connecting assembly 40 are spaced apart along the corresponding side of the housing 10 and bridged by a bridging panel 46 slidably overlappingly engaged with, supported from and extending between the corresponding end panel sections 34. Accordingly, the connecting panel assemblies 40 may be extended and contracted, longitudinally, in order to adapt the sun shroud 30 for use in conjunction with housings corresponding to the housing 10 having different plan area dimensions.

It will be noted from FIG. 1 of the drawings that the corner sections 32 at the housing corners defining the opposite ends of the longitudinal side wall 12 of the housing 10 are not connected by a connecting panel assembly 40. Accordingly, only three connecting panel assemblies 40 are utilized in that form of the sun shroud 30 illustrated in the drawings. Of course, if the ducts 22 and 24 opened into the housing 10 at lower elevations, were smaller or opened into the housing 10 through the bottom thereof, the sun shroud 30 could utilize four connecting panel assemblies 40.

The sun shroud 30 additionally includes an upper horizontal panel 50 of substantially the same plan shape and size as the top wall 20 of the housing 10. The four corner portions of the horizontal panel are supported from the top wall 20 through the utilization of corner support brackets 52 and the panel 50 is mounted from the top wall of the housing in vertically spaced relation above the top wall 20 and also above the upper marginal portions of the panel portions 34 and the connecting panel assemblies 40, which upper marginal portions are also vertically spaced above the top wall 20.

If the housing 10 is provided with the flue pipe 28, an opening 56 is formed in the horizontal panel 50 to accommodate the pipe 28. Further, if the top wall 20 of the housing 10 is equipped with the condensing air outlet opening 26, the horizontal panel 50 is provided with a similar opening 58 and a short tubular duct 60 is disposed vertically between the top wall 20 and the horizontal panel 50, the upper and lower ends of the duct 60 being secured to the horizontal panel 50 and the top wall 20 about the openings 58 and 26, respectively.

Figure 4:
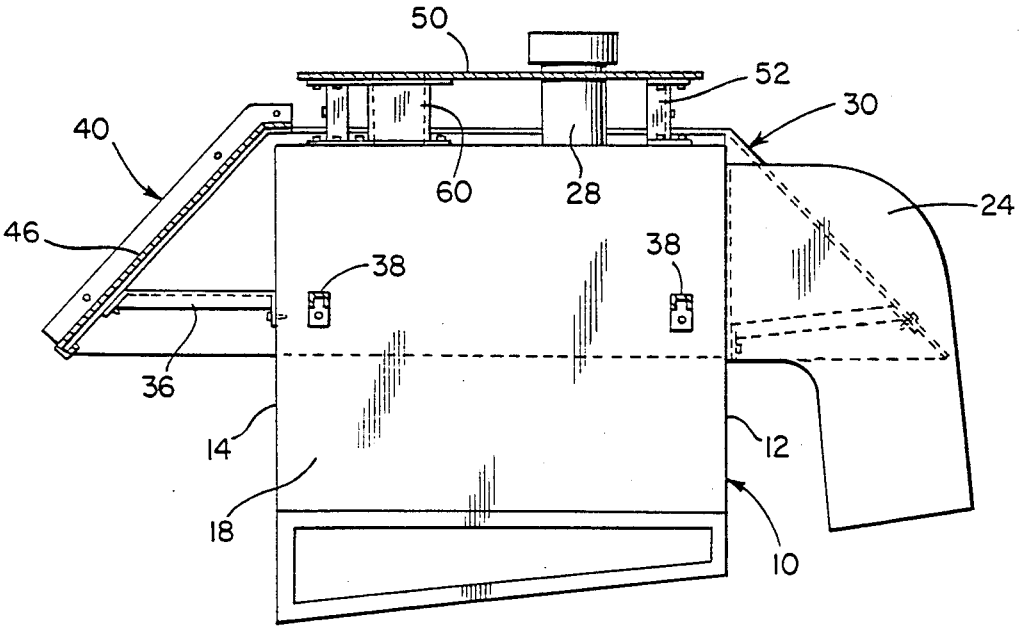
FIG. 4 is an enlarged vertical sectional view taken substantially upon the plane indicated by the section line 4-4 of FIG. 1.
Figure 5:
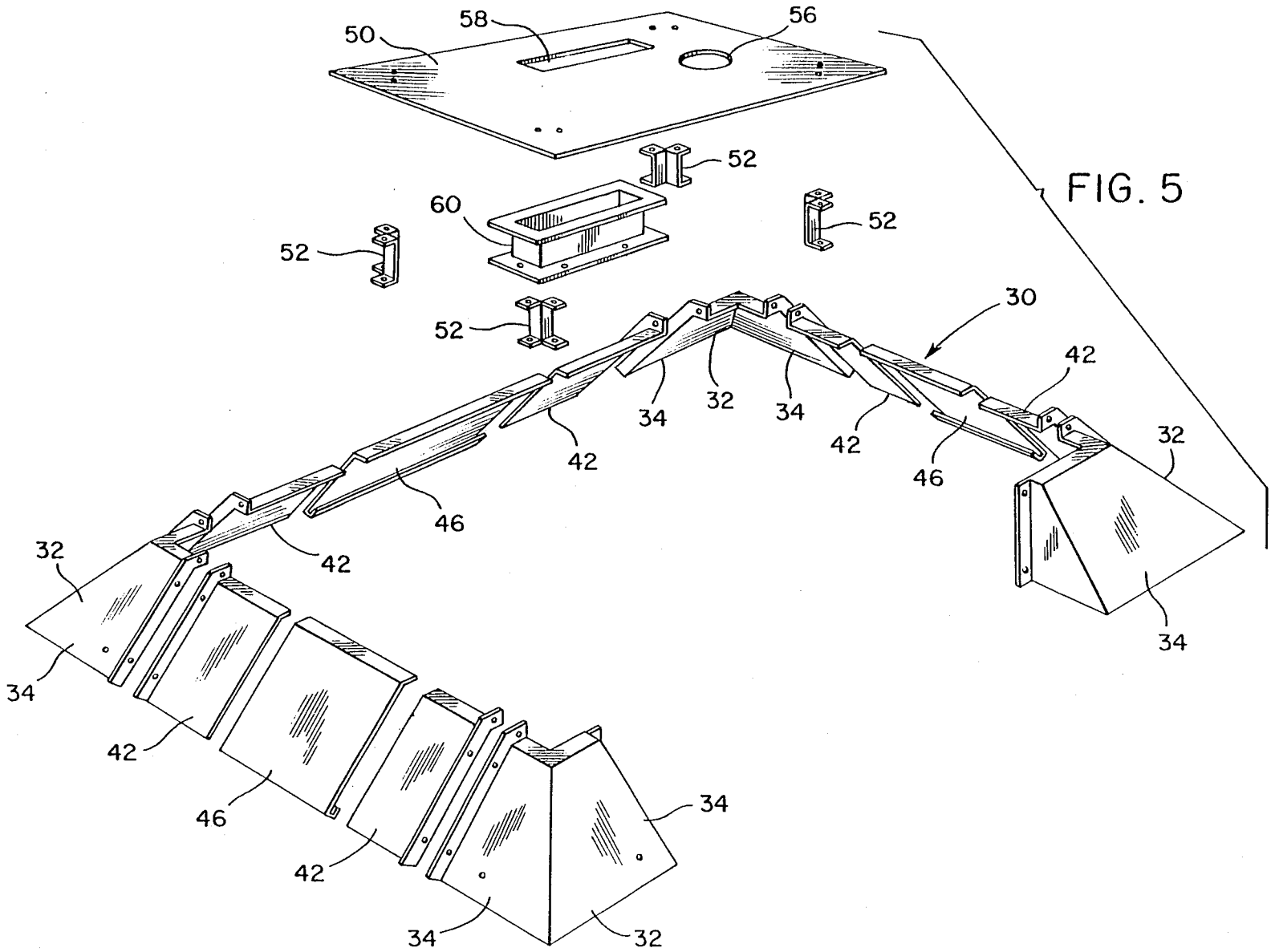
FIG. 5 is an exploded perspective view of the sun shroud.

From FIGS. 3 and 4 of the drawings it may be seen that substantially all of the housing 10 is shielded from direct sunlight incident thereon from above. Accordingly, the external surfaces of the housing 10 are not heated by direct sunlight. In addition, inasmuch as the various portions of the sun shroud 30 are spaced relative to the upper marginal edges of the walls 12, 14, 16 and 18 and the horizontal panel 50 is spaced above the top wall 20, the circulation of ambient air about the housing 10 is facilitated, whereby any heat buildup of the various walls of the housing 10 as a result of radiant heat energy thereon from within the housing may be reduced by air circulating about the external surfaces of the housing.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a multi-sided cooler housing having pairs of adjacent upstanding peripheral sides intersecting at corner portions of said housing and including upper marginal portions, said housing including a top wall extending between said upper marginal portions of said peripheral sides, a sun shroud including a corner section mounted from each of said corner portions with each corner section including a pair of interconnected, downwardly and outwardly inclined and relatively angulated panel portions extending partially along the corresponding peripheral sides of said housing toward the adjacent corner portions of said housing with opposing panel portions extending toward each other along each peripheral side being spaced apart along that peripheral side, at least all but one of said peripheral sides including a downwardly and outwardly inclined connecting panel assembly spanning between the corresponding panel portions, each connecting panel assembly including spaced opposite end panel sections mounted from the corresponding panel portions and a bridging panel slidingly and overlappingly engaged with and extending and supported from the corresponding end panel sections, said bridging panels, opposite end panel sections and panel portions including upper marginal edges spaced above the upper marginal edges of the corresponding peripheral sides of said housing.

2. The housing and sun shroud combination of claim 1 including a horizontal panel of at least generally the same plan shape and size of said top wall, means supporting said horizontal panel from and in vertically spaced relation above said top wall and with said horizontal panel spaced above the upper marginal edges of said bridging panels, opposite end panel sections and panel portions.

3. The combination of claim 2 wherein the vertical spacing between said horizontal panel and the upper marginal edges of said bridging panels, opposite end panel sections and said panel portions is greater than the vertical spacing between said top wall and the upper marginal edges of said bridging panels, opposite end panel sections and said panel portions.

4. The combination of claim 3 wherein said top wall includes an upwardly opening outlet opening formed therein and said horizontal panel includes an outlet port formed therethrough aligned with said outlet opening, and a short upstanding tubular duct extending between and including upper and lower ends anchored to said horizontal panel and top wall about said outlet port and outlet opening, respectively.

5. The combination of claim 2 wherein said housing includes an upwardly projecting flue duct opening upwardly through said top wall and projecting thereabove, said horizontal panel including a duct opening formed therein upwardly through which said flue duct is snugly received.

6. The combination of claim 5 wherein the vertical spacing between said horizontal panel and the upper marginal edges of said bridging panels, opposite end panel sections and said panel portions is greater than the vertical spacing between said top wall and the upper marginal edges of said bridging panels, opposite end panel sections and said panel portions.

7. The combination of claim 6 wherein said top wall includes an upwardly opening outlet opening formed therein and said horizontal panel includes an outlet port formed therethrough aligned with said outlet opening, and a short upstanding tubular duct extending between and including upper and lower ends anchored to said horizontal panel and top wall about said outlet port and outlet opening, respectively.

8. In combination with a cooler housing including peripherally extending side wall portions having upper marginal edges and a top wall extending between and connecting upper marginal portions of said side wall portions, a sun shroud, said shroud including downwardly and outwardly inclined panel portions extending about at least a major portion of said wall portions, said shroud panel portions including upper marginal edge portions spaced outwardly from said top wall and terminating upwardly above the upper marginal edges of said side wall portions to define convection air flow passages beneath said shroud panel portions between the upper marginal edge portions of said panel portions and said top wall.

9. The housing and shroud combination of claim 8 including a horizontal panel of at least generally the same plan shape and size of said top wall, means supporting said horizontal panel from and in vertically spaced relation above said top wall with said horizontal panel spaced above the upper marginal edges of said panel portions.

10. The combination of claim 9 wherein the vertical spacing between said horizontal panel and the upper marginal edges of said panel portions is greater than the vertical spacing between the said upper marginal edges of said panel portions and the upper marginal edges of said side wall portions.

11. In combination with a multi-sided cooler housing having pairs of adjacent upstanding peripheral sides intersecting at corner portions of said housing and including upper marginal portions, said housing including a top wall extending between said upper marginal portions of said peripheral sides, a sun shroud including a corner section mounted from each of said corner portions with each corner section including a pair of interconnected, downwardly and outwardly inclined and relatively angulated panel portions extending partially along the corresponding peripheral sides of said housing toward the adjacent corner portions of said housing with opposing panel portions extending toward each other along each peripheral side being spaced apart along that peripheral side, at least all but one of said peripheral sides including a horizontally elongated and downwardly and outwardly inclined connecting panel assembly spanning between and including opposite ends supported from the corresponding panel portions, each connecting panel assembly including relatively horizontally extendable and retractable panel sections, said connecting panel assemblies and panel portions including upper marginal portions spaced outward from said top wall and terminating upwardly above said top wall to define convection air flow passages beneath said panel portions and connecting panel assemblies between the upper marginal edge portions of said connecting panel assemblies and panel portions and the upper marginal portions of said peripheral sides.

12. The cooler housing and sun shroud combination of claim 11 including a horizontal panel of at least generally the same plan shape and size of said top wall, means supporting said horizontal panel from and in vertically spaced relation about said top wall and with said horizontal panel spaced above the upper marginal edges of said angulated panel portions and connecting panel assemblies.

* * * * *